US006226828B1

(12) United States Patent
Lin

(10) Patent No.: US 6,226,828 B1
(45) Date of Patent: May 8, 2001

(54) BRUSH FOR REMOVING DUST

(76) Inventor: Cee Lin, 146, Sec. 1, Chun-Shan Rd., Hua-Tan, Chung-Hua (TW)

( * ) Notice: Subject to any disclaimer, the term of this patent is extended or adjusted under 35 U.S.C. 154(b) by 0 days.

(21) Appl. No.: 09/475,137

(22) Filed: Dec. 30, 1999

(51) Int. Cl.[7] ..... A46B 9/10
(52) U.S. Cl. ..... 15/184
(58) Field of Search ..... 15/184

(56) References Cited

U.S. PATENT DOCUMENTS

| | | | | |
|---|---|---|---|---|
| 380,080 | * | 3/1888 | Bouton et al. | 15/184 |
| 1,054,229 | * | 2/1913 | Methven | 15/184 |
| 1,188,214 | * | 6/1916 | Sohn | 15/184 X |
| 1,230,660 | * | 6/1917 | Brice | 15/184 |
| 1,355,026 | * | 10/1920 | Austin | 15/184 X |
| 1,588,633 | * | 6/1926 | Taylor | 15/184 X |
| 2,043,250 | * | 6/1936 | Kasdan et al. | 15/184 X |
| 2,071,747 | * | 2/1937 | Houlihan | 15/184 X |
| 3,268,939 | * | 8/1966 | Aversa | 15/184 |

* cited by examiner

*Primary Examiner*—Mark Spisich
(74) *Attorney, Agent, or Firm*—Bacon & Thomas, PLLC

(57) ABSTRACT

A brush for wiping out dust is formed of a hollow main body and a slide seat having a seat body and bristles attached to the front end of the seat body. The main body is provided in the wall thereof with a through slot extending the longitudinal direction of the main body. The through slot is provided at the front end thereof with a receiving slot. The seat body is provided at the rear end thereof with a protrusion which is retained in the receiving slot of the through slot of the main body at the time when the slide seat is detachably fastened with the main body. The slide seat is entirely drawn into the hollow main body when the protrusion of the seat body of the slide seat is moved along the through slot to arrive at the rear end of the through slot.

2 Claims, 5 Drawing Sheets

BRUSH FOR REMOVING DUST

FIELD OF THE INVENTION

The present invention relates generally to a brush, and more particularly to a dust-removing brush.

BACKGROUND OF THE INVENTION

The dust deposited on a telephone set, a fax machine, a television set, a computer, etc. is generally wiped out with a dry or wet cleaning cloth, or a static paper. The method of wiping out the dust with a cleaning cloth or paper can often trigger inadvertently a switch or key of the machines referred to above. In addition, the dust can not be effectively removed by a cleaning cloth or paper.

SUMMARY OF THE INVENTION

It is therefore the primary objective of the present invention to provide a dust-removing brush which is free from the drawbacks of the cleaning cloth or paper described above.

It is another objective of the present invention to provide a dust-removing brush which is simple in construction and can be easily carried around.

The objectives, features, functions, and advantages of the present invention will be readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
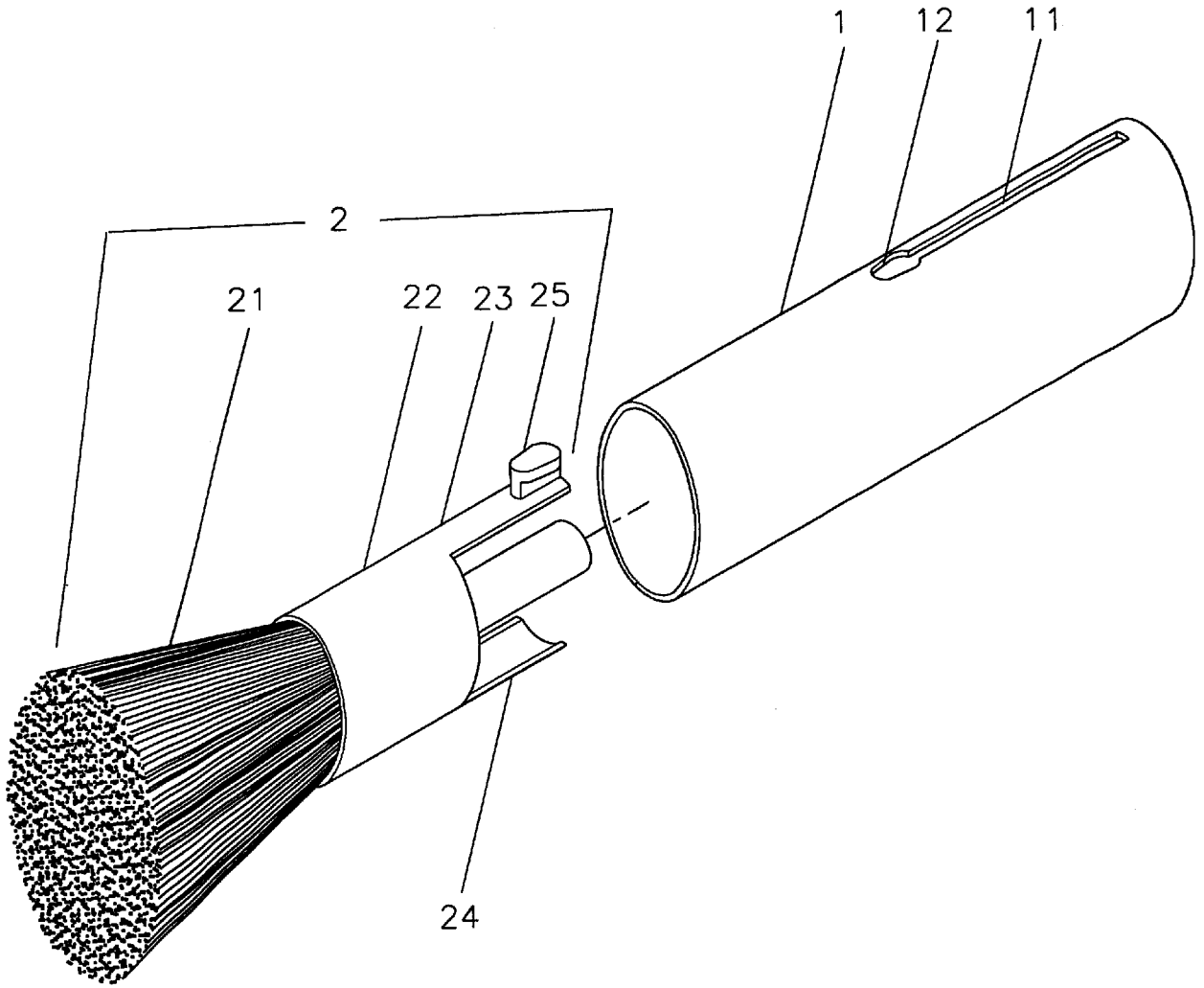
FIG. 1 shows an exploded view of the preferred embodiment of the present invention.

As shown in FIG. 1, a brush embodied in the present invention comprises mainly a main body 1 and a slide seat 2.

The main body 1 is of a hollow tubular construction and is provided in the wall thereof with an elongated through slot 11 of a predetermined length and extending along the direction of a longitudinal axis of the main body 1. The through slot 11 is provided at the front end thereof with a protrusion receiving slot 12.

The slide seat 2 has a seat body 22, which is dimensioned to fit into the hollow main body 1. The seat body 22 is equal in length to the through slot 11 of the main body 1. The seat body 22 is provided at the rear end thereof with an upper slide piece 23 and a lower slide piece 24. The upper slide piece 23 is provided at the rear end thereof with a protrusion 25. The seat body 22 is provided at the front end thereof with bristles 21 attached thereto.

Figure 2:
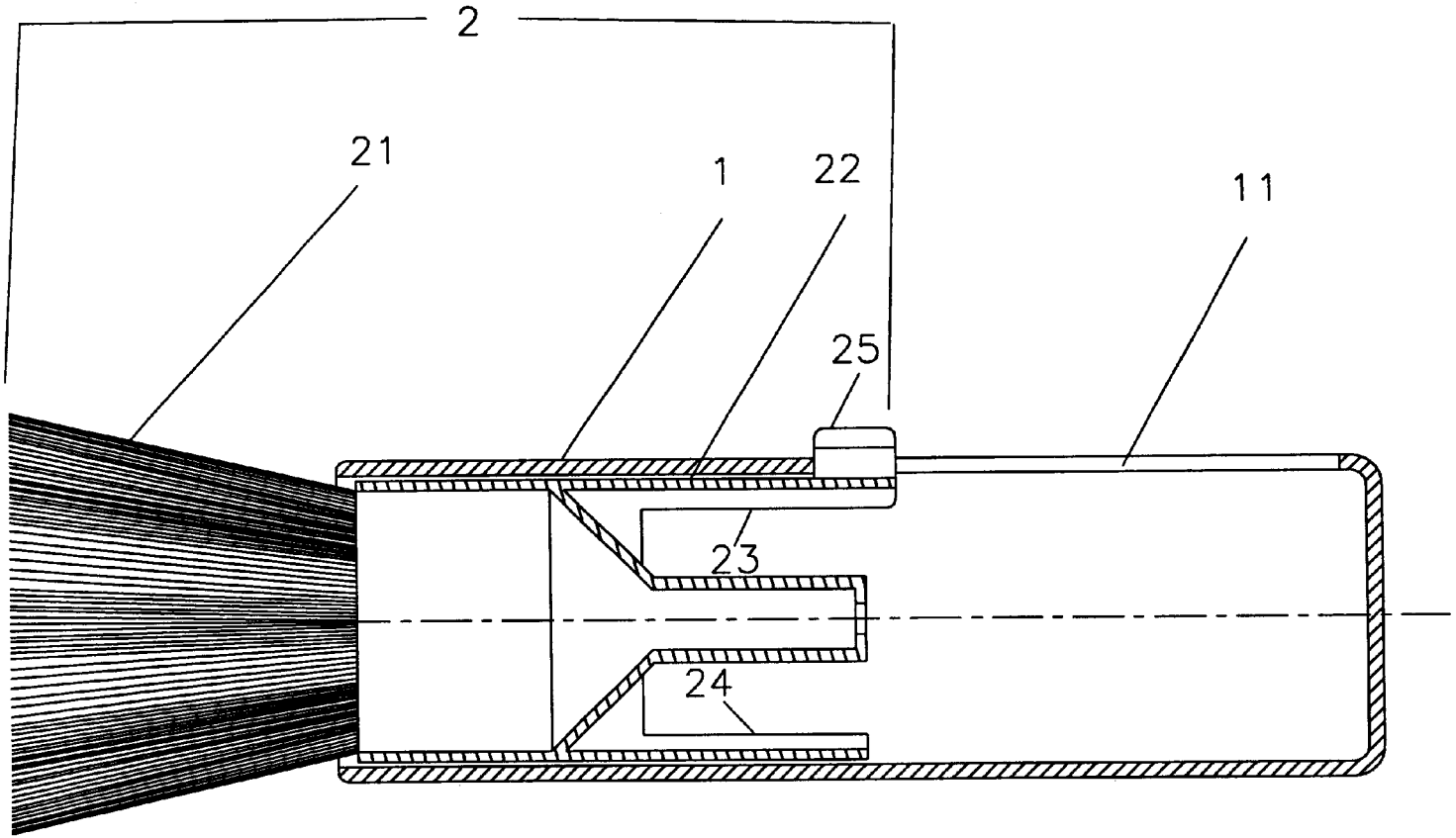
FIG. 2 shows a longitudinal sectional view of the preferred embodiment of the present invention in combination.
Figure 3:
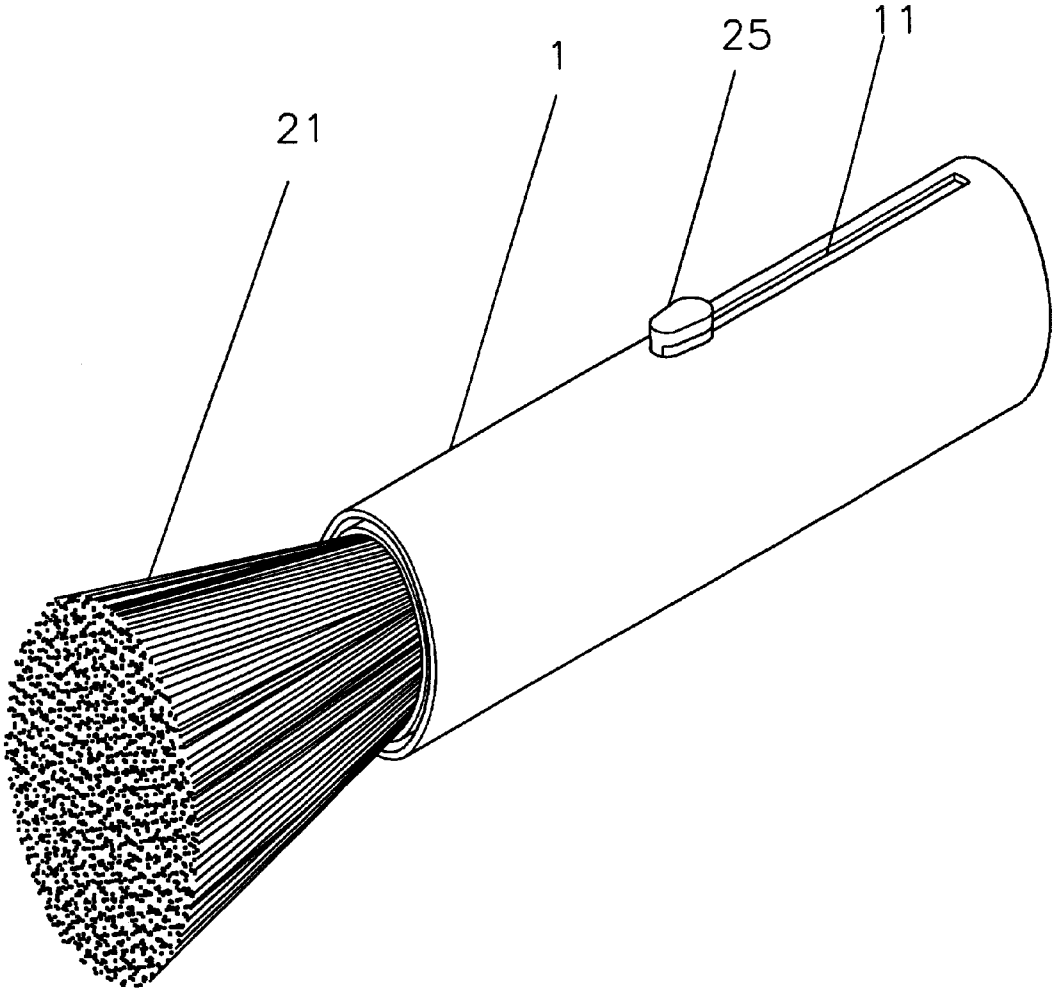
FIG. 3 shows a perspective view of the preferred embodiment of the present invention in combination.

As shown in FIGS. 2 and 3, before the seat body 22 is fitted into the main body 1, the upper slide piece 23 and the lower slide piece 24 are pressed to bend toward each other so as to enable the rear end of the seat body 22 to be inserted into the main body 1 such that the protrusion 25 of the upper slide piece 23 of the seat body 22 is retained in the protrusion receiving slot 12 of the through slot 11. As a result, the slide seat 2 is securely retained by the main body 1.

The slide seat 2 can be disengaged with the main body 1 by pressing the protrusion 25 to move out of the protrusion receiving slot 12, thereby enabling the seat body 22 of the slide seat 2 to be taken out of the front end of the main body 1.

Figure 4:
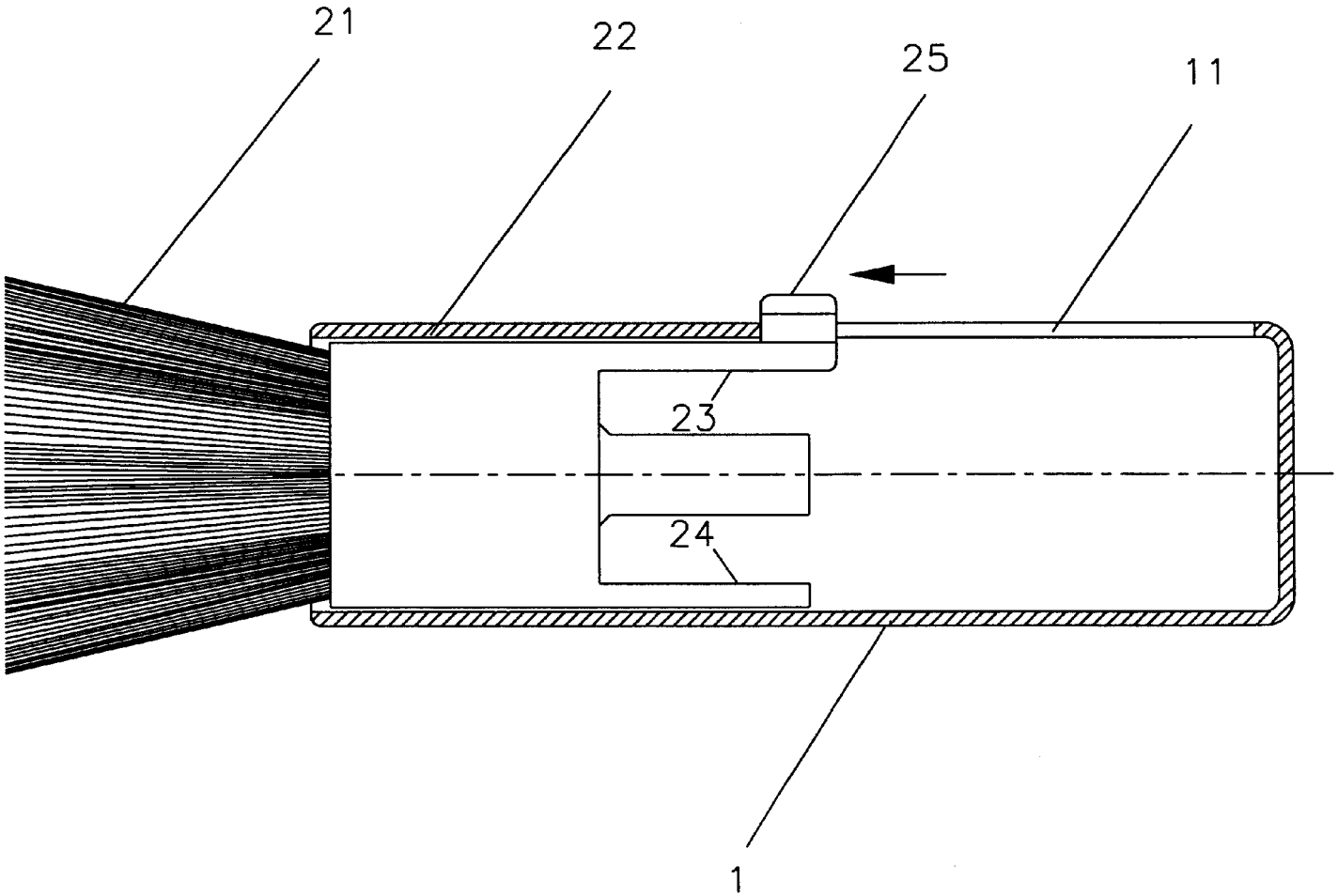
FIG. 4 shows a schematic view of the preferred embodiment of the present invention in extraction state.
Figure 5:
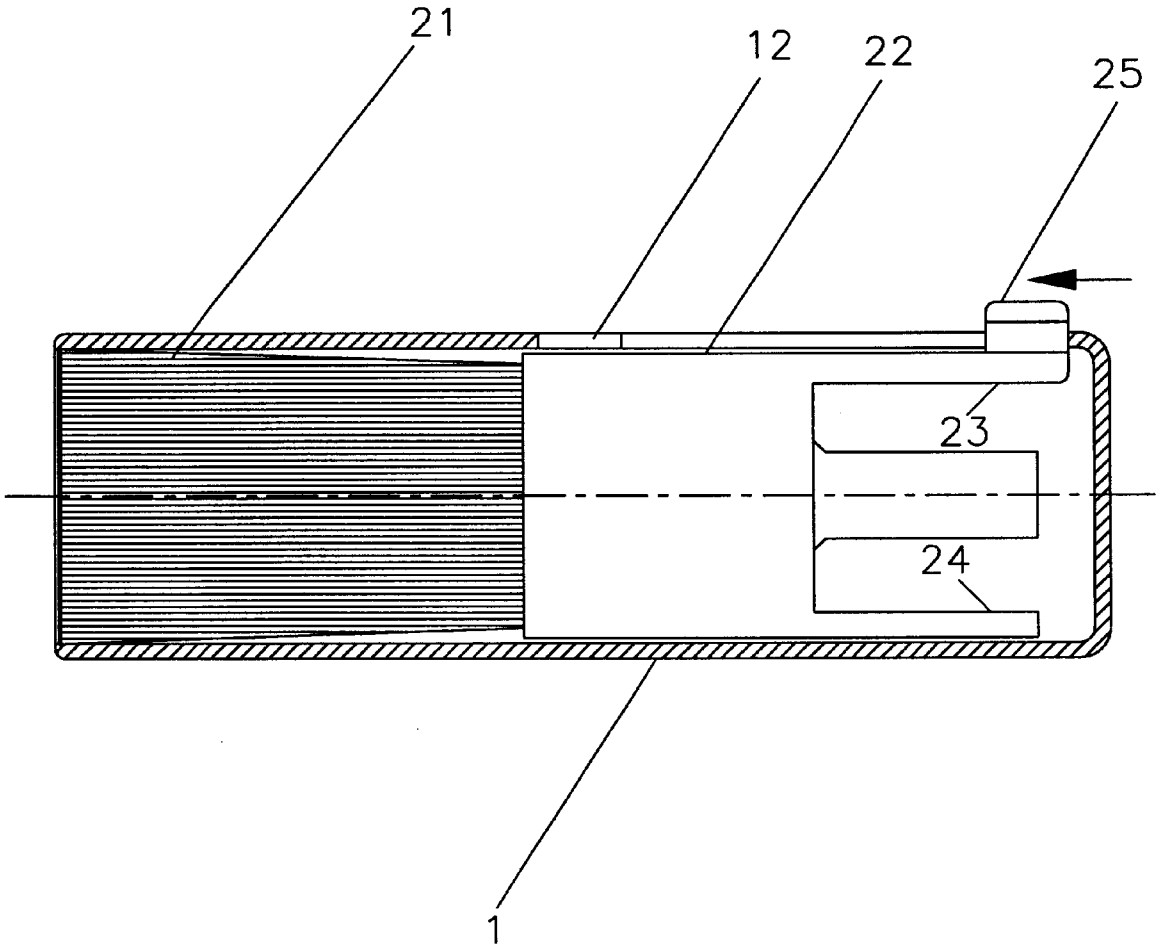
FIG. 5 shows another schematic view of the preferred embodiment of the present invention in retraction state.

As illustrated in FIGS. 4 and 5, the slide seat 2 can be extracted from the main body 1 or retracted into the main body 1. In retracting the slide seat 2 into the main body 1, the protrusion 25 is moved along the through slot 11 to arrive at the rear end of the through slot 11. As a result, the slide seat 2 is received in its entirety in the main body 1. The brush of the present invention is thus rather handy.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A dust-removing brush comprising:

a main body of a hollow tubular construction and provided in a wall thereof with an elongated through slot of a length and extending along the direction of a longitudinal axis of said main body whereby said through slot is provided at a front end thereof with a receiving slot;

a slide seat having a seat body and bristles attached to a front end of said seat body whereby said seat body is dimensioned to fit into said hollow main body and is equal in length to said through slot of said main body, said seat body being provided at a rear end thereof with an upper slide piece and a lower slide piece whereby said upper slide piece is provided at a rear end thereof with a protrusion which is retained in said receiving slot of said through slot of said main body at such time when said slide seat is detachably fastened with said main body.

2. The dust-removing brush as defined in claim 1, wherein said slide seat is entirely drawn into said main body at the time when said protrusion of said seat body of said slide seat is moved along said through slot to arrive at a rear end of said through slot.

* * * * *